US011291599B2

(12) United States Patent
Newton

(10) Patent No.: US 11,291,599 B2
(45) Date of Patent: Apr. 5, 2022

(54) CELL INFLATION OF A MATTRESS

(71) Applicant: HUNTLEIGH TECHNOLOGY LIMITED, Bedfordshire (GB)

(72) Inventor: Michael David Newton, Newport (GB)

(73) Assignee: HUNTLEIGH TECHNOLOGY LIMITED, Bedfordshire (GB)

( * ) Notice: Subject to any disclaimer, the term of this patent is extended or adjusted under 35 U.S.C. 154(b) by 504 days.

(21) Appl. No.: 15/118,378

(22) PCT Filed: Jan. 15, 2015

(86) PCT No.: PCT/GB2015/050072

§ 371 (c)(1),
(2) Date: Aug. 11, 2016

(87) PCT Pub. No.: WO2015/124897

PCT Pub. Date: Aug. 27, 2015

(65) Prior Publication Data

US 2017/0172830 A1 Jun. 22, 2017

(30) Foreign Application Priority Data

Feb. 20, 2014 (GB) ..... 1402974

(51) Int. Cl.
*A61G 7/057* (2006.01)
*A47C 27/08* (2006.01)
*A47C 27/10* (2006.01)

(52) U.S. Cl.
CPC ..... *A61G 7/05776* (2013.01); *A47C 27/082* (2013.01); *A47C 27/083* (2013.01); *A47C 27/10* (2013.01)

(58) Field of Classification Search
CPC ..... A61G 7/05776; A47C 27/082; A47C 27/083; A47C 27/10; A47C 27/00; A47G 2009/003; A47G 9/0292; A47G 7/05776
See application file for complete search history.

(56) References Cited

U.S. PATENT DOCUMENTS 4,617,690 A * 10/1986 Grebe ..... A61G 7/05769 5/710
5,243,721 A 9/1993 Teasdale
(Continued)

FOREIGN PATENT DOCUMENTS

| | | | |
|---|---|---|---|
| GB | 2320429 | A | 6/1998 |
| WO | 2002045641 | A1 | 6/2002 |
| WO | 2006023479 | A2 | 3/2006 |

OTHER PUBLICATIONS

International Search Report & Written Opinion dated Sep. 4, 2015 in corresponding International Patent Application No. PCT/GB2015/050072 filed Jan. 15, 2015 (14 pages).

*Primary Examiner* — Myles A Throop
(74) *Attorney, Agent, or Firm* — The Webb Law Firm

(57) ABSTRACT

Inflatable mattress apparatus includes a mattress provided with a plurality of inflatable cells (A, B); a manifold unit (V1-V4) connected to the plurality of cells, wherein the manifold (V1-V4) couples the cells into a plurality of individual sets of cells; and a control unit connected to the manifold, the control unit being operable to provide substantially simultaneous inflation and deflation of cells (A, B) in each set of cells over a period, and time offset inflation and deflation of cells in different sets of cells. The apparatus can provide the same benefits of a 1 of 2' system with reduced movement of the entire surface at any point in the cycle, less air moving at any given time and thus a reduction in the audible noise produced in any pump supplying the air and the associated airflow in the mattress. The arrangement provide other benefits too.

16 Claims, 7 Drawing Sheets

(56) References Cited

U.S. PATENT DOCUMENTS

| | | | | |
|---|---|---|---|---|
| 5,267,364 | A * | 12/1993 | Volk | A61G 7/05776 5/710 |
| 5,651,151 | A | 7/1997 | Schild | |
| 5,685,036 | A | 11/1997 | Kopfstein et al. | |
| 5,983,428 | A * | 11/1999 | Hannagan | A61G 7/05776 5/710 |
| 9,566,202 | B2 * | 2/2017 | Chiang | A61G 7/0525 |
| 2004/0261185 | A1 * | 12/2004 | Ellis | A61G 7/0507 5/713 |
| 2007/0186349 | A1 | 8/2007 | Lipman et al. | |
| 2008/0109964 | A1 * | 5/2008 | Flocard | A61B 5/6891 5/713 |
| 2008/0201858 | A1 | 8/2008 | Caminade | |
| 2009/0100604 | A1 * | 4/2009 | Caminade | A61G 7/05776 5/713 |
| 2011/0296621 | A1 * | 12/2011 | McKenna | A61G 7/05776 5/671 |
| 2014/0223665 | A1 * | 8/2014 | Chapin | A47C 27/10 5/710 |

* cited by examiner

CELL INFLATION OF A MATTRESS

This is a nationalization of International Patent Application No. PCT/GB2015/050072, filed on Jan. 15, 2015, pursuant to 35 USC § 371, which in turn claims benefit of priority to Great Britain Application No. 1402974.8, filed on Feb. 20, 2014; the entire disclosures of all the above applications are expressly incorporated by reference herein.

The present invention relates to improvements in the design and operation of therapeutic support surfaces such as an air mattress. The preferred embodiments disclosed herein use a time-based differential pressure profile in the various inflatable cells used to support the patient and also use a controlled phase relationship (in terms of pressure & time) between the inflation/deflation of the various physically separated cells in the support surface.

The preferred embodiments are able to reduce the patient's sensation of movement on an alternating therapeutic surface without any reduction in the performance of the surface. Moreover, the control and physical arrangement of various inflatable cells of the device can be made to operate in an alternating manner with a controllable and selectable relationship between the inflation/deflation timings of various cells instead of all operating at the same time. This feature can be described as a "phased crossover" since the pressures between a given set of individual (A & B) cells equalise and patient support crosses from the A cell to the B cell with a phase relationship compared to other sets of A & B cells).

There are many alternating pressure support systems currently available (e.g. the Nimbus system sold by the applicant, ArjoHuntleigh) which provide two sets of inflatable cells (denoted as A and B) and which operate in an alternating mode, best described as a '1 of 2' method. The patient is supported by one set of cells out of the two available sets for a first period of time and then the air pressure is transferred between the sets of cells and the patient is then supported on the other set of cells for a second period of time.

These cells are arranged within a support surface in an alternate arrangement e.g. A-B-A-B, so that the effect of the cell inflation sequence is distributed along the length of the patient's body.

In the operation of these systems, for a part of the time one set of cells (e.g. A) is inflated to support the patient, while the other set (e.g. B) is deflated to relieve pressure on the patient's anatomy in those physical areas that relate to these (e.g. B) cells. The system alternates between these two states in a controlled manner and then repeats. The duration of this repeating activity is known as the cycle time, typically around 10 minutes. As a result of this mode of operation, the transition between these two states (e.g. from A inflated with B deflated to A deflated with B inflated) results in a large proportion of the surface of the mattress being changed when the alternating cycle changes the pressures in the mattress (shown in FIG. 1).

In addition, there is a crossover state where the A and B pressures are equalised, which occurs twice in each cycle. During this state, all the cells (both A & B) are connected together and change in order to equalise pressure between them (as shown in FIG. 2). During this state the mattress pressure is changing and as a result the patient experiences the sensation that the entire surface of the mattress is moving which can be uncomfortable or alarming.

The operation of a traditional mattress and pumps involves all the A cells being connected together and all the B cells being connected together, hence each set of cells changes pressure at the same point in time. This is typically because in order to simply the pump design, a single rotary valve is used to provide air distribution in a common manner to all cells.

As a result, for the majority of the time in each cycle, the mattress provides a surface in which the alternating cells that represent a large proportion of the mattress cells are changing pressure and most significantly, all at the same time. The resulting movement and the associated sensation of movement may be less than ideal for some patients whose clinical situation is such that they require a more stable surface but who also need the benefit of alternating pressure relief.

An important point to note is the changing of pressure in the mattress (as shown in FIG. 2). There is relatively little time within the overall cycle time where the patient is supported on a constant pressure surface anywhere on the mattress. As a result, this changing pressure can also cause either the perception of movement or actual patient movement.

Competitive systems claim benefits and advantages over the '1 of 2' configuration by utilising a '1 of 3' or '1 of 4' system. This approach results in a larger proportion of the cells being inflated at a fixed pressure at any given time in the cycle. As a result, the patient does not sense or is subjected to as much movement as on a '1 in 2' surface. The corresponding disadvantage is that the pressure is not relieved from the areas of the surface as often as would be the case in a '1 of 2' system. So in therapeutic terms the '1 of 2' system is demonstrably preferable over '1 of 3' of '1 of 4' systems.

It is well known within the prior art of alternative sequences of cell inflation/crossover/deflation associated with a '1 of 2' system, e.g. having the deflated cell fully inflate before deflating the currently inflated cell. However, this also has the disadvantage of the average pressure being correspondingly higher in order to support the patient and hence the degree of pressure relief presented to the patient's anatomy is reduced and as a consequence not as clinically effective.

Therefore, for '1 of 2' systems, there is currently a fundamental compromise between cell movement and effective pressure relief.

In traditional alternating systems, the mattress can be considered as a multitude of pairs of A & B cells, the relationship of pressure versus time between A to B cells is the same for each pair. All the pairs can be considered as being in phase (i.e. no delay) with each other in terms of pressure—this is clearly because each pair is directly connected to each other pneumatically (A to A and B to B) throughout the mattress.

So the timing of the change of pressure between pairs of adjacent cells applies in common to all pairs of cells.

The present invention seeks to provide an improved variable pressure mattress.

According to an aspect of the present invention, there is provided inflatable mattress apparatus including a mattress provided with a plurality of inflatable cells; a manifold unit connected to the plurality of cells, wherein the manifold couples the cells into a plurality of individual sets of cells; and a control unit connected to the manifold, the control unit being operable to provide substantially simultaneous inflation and deflation of cells in each set of cells over a period, and time offset inflation and deflation of cells in different sets of cells.

Preferably, the control unit is operable to provide time offset inflation and deflation of cells between every set of cells, such that no two sets of cells are inflated and deflated at simultaneous time periods.

In one embodiment, time offset between sets of cells provides overlapping inflation and deflation periods between and least two of said sets of cells. The phase relationship between sets of cells may be less than 50% of the period, preferably less than 25%.

The phase relationship between sets of cells may be less than the inflation time required to inflate an individual cell.

Advantageously, each set of cells is independently coupled to the manifold and independently controllable.

In an embodiment, two or more sets of cells are jointly coupled to the manifold and/or jointly controllable.

The manifold preferably includes a valve unit coupled to each cell of a set of cells.

Preferably, an air distribution valve is coupled to the valve units. The apparatus may include at least one independent cell coupled directly to the air distribution valve and inflatable or deflatable to a static state of inflation or deflation.

The cells of a set are disposed adjacent one another in the mattress. In another embodiment, the cells of different sets of cells are disposed between one another. It will be appreciated that in some cases it may be preferable to have a mattress with a mixture of sets of cells with adjacent cells and sets of cells with interdigitated cells.

In an embodiment, the control unit is operable to inflate and deflate the cells of the sets of cells in an order to produce a travelling pressure wave along at least a part of a surface of the mattress.

According to another aspect of the present invention, there is provided a method of inflating a mattress provided with a plurality of inflatable cells through a manifold unit connected to the plurality of cells, wherein the manifold couples the cells in a plurality of individual sets of cells; including the steps of substantially simultaneously inflating and deflating of cells in each set of cells over a first period, and inflating and deflating cells in different sets of cells during a second period offset in time relative to the first period.

In all embodiments of the invention, mattress cells located in the region of the patient's sacrum or lower torso may be arranged perpendicular to those located in the rest of the mattress.

Cells located in the area of the mattress associated with the sacrum of the patient may be operated at a different phase relative to those located elsewhere in the mattress.

The orthogonally arranged cells located in the region of the patients torso may have a different inflation profile compared to those located elsewhere in the mattress.

According to another aspect of the present invention, there is provided an inflatable medical mattress having a longitudinal extent with a head zone at one end, a foot zone at the opposite end and a sacral zone between the head and foot zones, and a transverse extent; the mattress including a plurality of inflatable cells arranged in a plurality of mattress zones, wherein in at least one of the zones the inflatable cells are elongate and oriented in along the transverse extent of the mattress and in at least the sacral zone the cells are elongate and extend substantially parallel to the longitudinal extent of the mattress.

The provision of longitudinally disposed cells in the sacral zone of the mattress allows the system to provide improved therapeutic operation within that zone. This mode of operation can be pumped to provide additional functions and features when required.

Preferably, the cells in all the mattress zones apart from the sacral zone the inflatable cells are elongate and extend in the transverse direction of the mattress.

Advantageously, different areas of the mattress are arranged to have different phase relationships. For example, the phase relationship of the pressures in the cells in the patients sacral region could be different from that applied in other areas of the mattress. This can be advantageous by allowing a specific localized therapy to be provided in this physical area of the patient compared to that provided elsewhere on the mattress.

Embodiments of the present invention are described below, by way of example only, with reference to the accompanying drawings, in which.

The preferred embodiments are able to address the compromise or existing systems and to achieve the high levels of pressure relief of a conventional '1 of 2' system with the increased comfort and lack of movement of a '1 of 3' or '1 of 4' system. The preferred embodiments can provide a system combining the highest levels of pressure relief performance with additional improvements to the patient in terms of reduced movement and comfort.

As is described below in detail, the preferred embodiments differ specifically due to their timing aspect, whilst the cycle time remaining the same for each given pair of cells, the connection of each A/B pair occurs at a different point in time for each pair. Moreover, the phase timing pairs of cells is specifically controlled and delayed with respect to others in order to adjust in time the pressures so that more of the mattress is stable at any given time. The same alternating cycle time is provided for each of the multiple pairs and also between the individual A & B cells within a pair. Hence the same underlying pressure relief is provided in terms of time when the pressure is removed from any given cell.

This approach is preferably achieved by having multiple sets of paired of A and B cells each pair being connected independently to the air source. Whilst the air pressure is still transferred between the individual A/B pairs, the phased manner provides a time averaging effect across the mattress due to the various different pair of cells being connected at different times. Moreover, the level of pressure used in the operation of the described system can remain at exactly the same pressure, so the underlying pressures provided for any given patient are unchanged compared. This has a number of benefits in terms of the design, construction and clinical evidence of effectiveness. It also means that this functionality can be readily provided as an optional new mode of operation alongside existing modes of operation. Hence this can be selected when specifically required by the user/healthcare professional for a given patient or can be automatically selected for specific periods of time (for example at night to promote sleeping).

This preferred mode of operation has the effect of providing a phased crossover, defined as the point in the cycle where the NB cell pressures are equalising. This phasing results in a number of individual cell crossovers occurring at multiple times within the overall cycle instead of a single crossover event applied to all alternating cells. The resultant effect is that the same number of mattress cells change pressure (e.g. 1 of 2) and at the same rate as the current design—but not all do so at the same point in time. This has distinct benefits to the design and operation of alternating systems.

Figure 1:
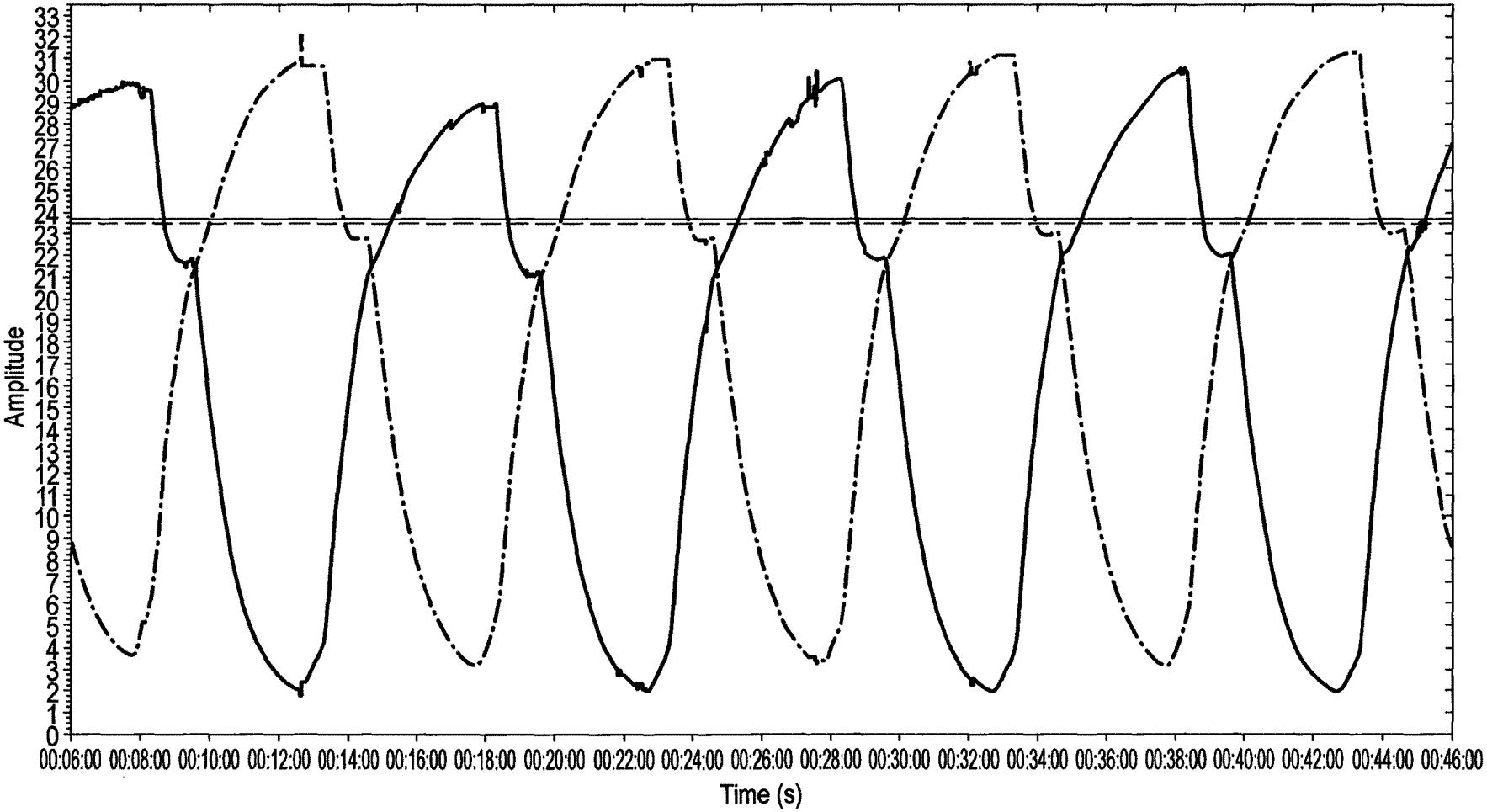
FIG. 1 shows an example of a typical relationship between A and B cells in traditional alternating therapy.
Figure 2:
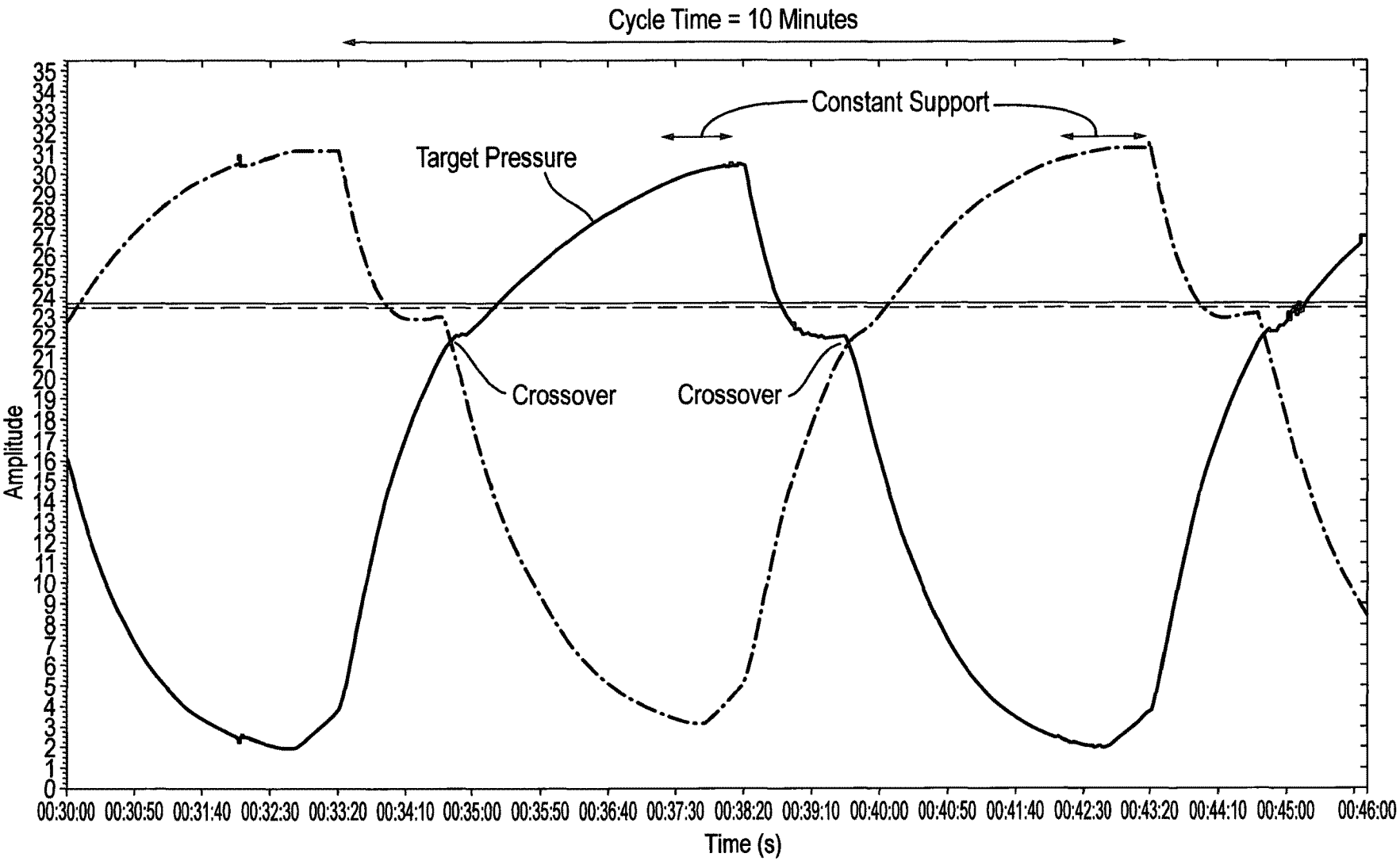
FIG. 2 shows the key elements of the cycle time of traditional alternating therapy.
Figure 3:
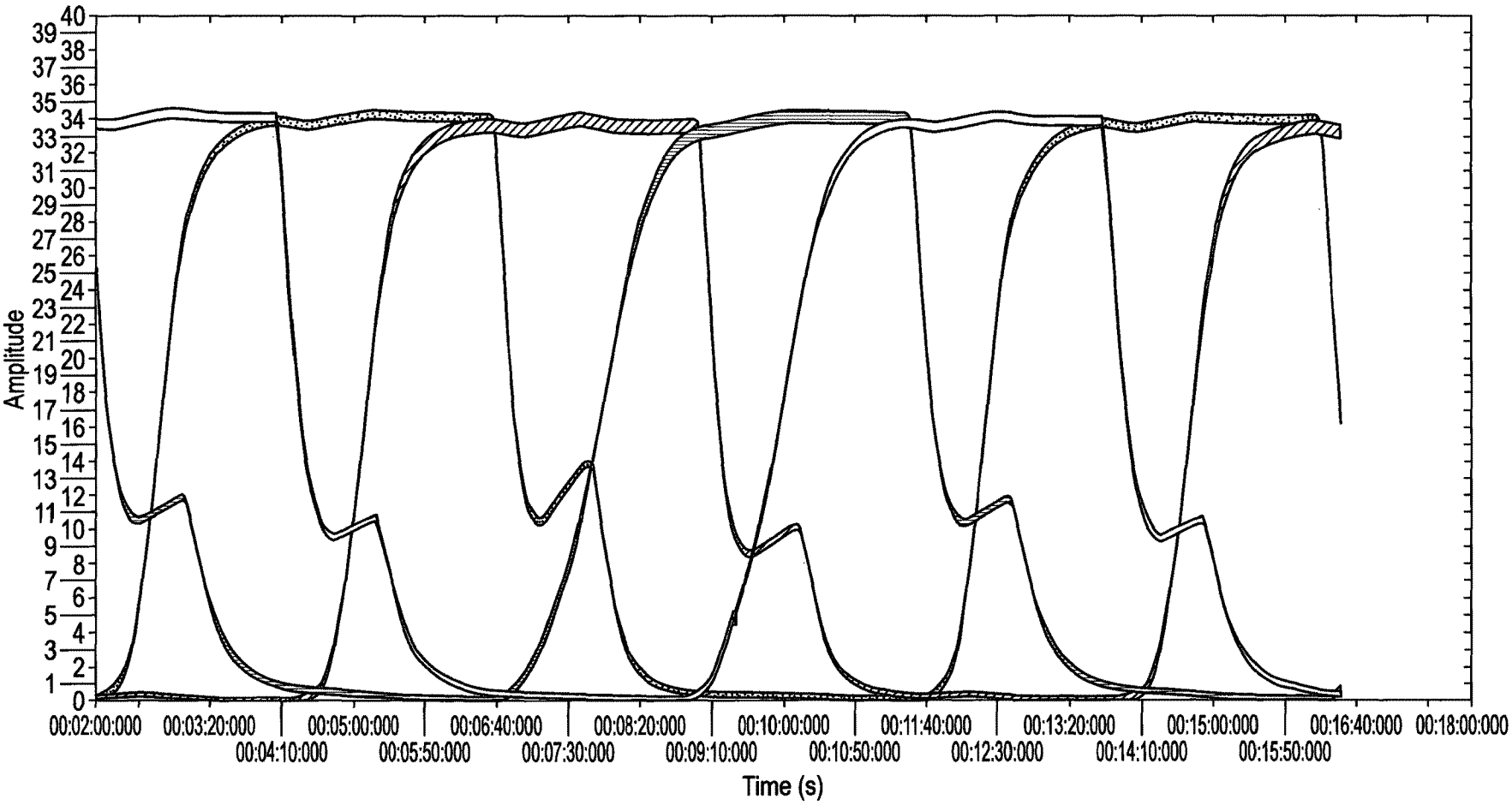
FIG. 3 shows the use of multiple pairs of cells and a phase relationship.

In FIG. 3, there are four separate alternating pressure waveforms, each with the same 10 minute cycle time as shown in FIG. 1. However, the waveforms are delayed in time to ensure that the timings of each overlap. These are all intended to apply to a given cell type (for instance calls of type A) and therefore there are the equivalent B waveforms, which are the opposite sense (see FIG. 4). As a result, there is always at least one output which is stable at the target pressure. Hence when these outputs are applied to multiple pairs of cells, spaced at multiple locations on the mattress this results in a number of areas that are stable at the target pressure at any point in time. Therefore as a result there is less physical movement in the mattress.

Figure 4:
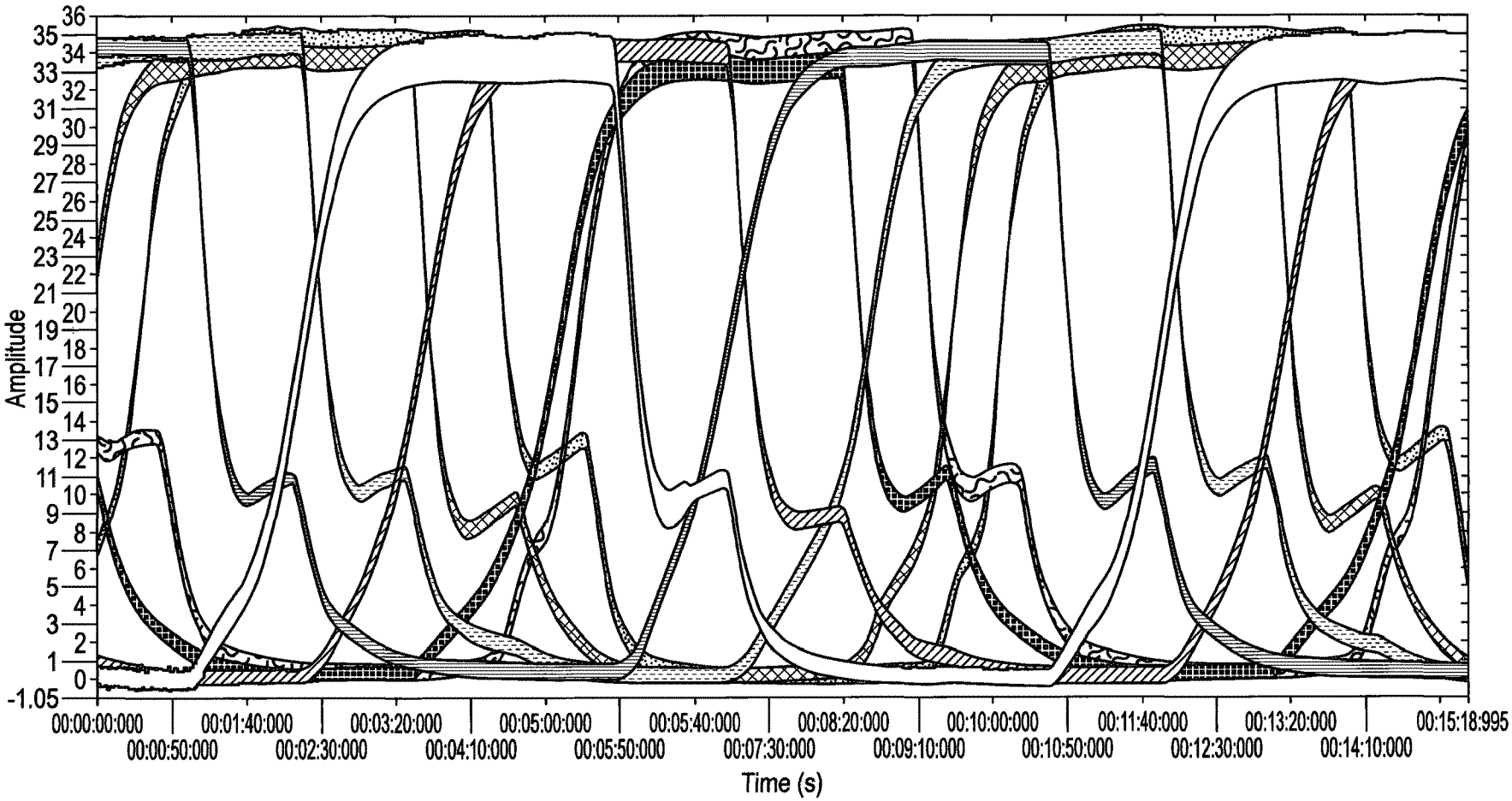
FIG. 4 shows the use of multiple pairs of cells with phase relationship significantly less than the cycle time.

FIG. 4 shows an example of timing relationship, where the rises and falls in pressure and the associated crossovers are spread throughout the cycle time. As a result, mattress movement is reduced as each crossover involves less cells, less volume of air and the changing pressure occupies less area of the mattress and as a result more of the mattress is stable at any given time. This results in a more stable support surface.

Patient support is therefore achieved from the combination of all of these individual pneumatic outputs over time instead of the two waveforms shown in FIG. 1.

In the preferred system, when the pressure in an alternating cell is reduced, the cells located to either side operate with a corresponding higher pressure. This adjacent pressure provides a localised compressive pressure to the tissue that limits the beneficial effect in the area receiving pressure relief.

There is a 'compartmentalised' effect where the tissue in proximity to the relieved pressure site has a higher pressure and this can therefore block the flow of blood and lymphatic fluid and the associated circulatory benefits to the tissue in the area with relieved pressure including oxygenation in the tissue in the area of the relieved pressure.

By ensuring the phased crossover is applied in a suitably distributed manner to the cells in the surface, a sequence of inflations and hence pressures is associated with a range of physical location in the surface. This means that the pressure in the tissue in proximity to a relieved pressure site can be lower than would otherwise be the case for part of the time and therefore the previously described limitation on the blood flow is reduced.

In addition to this pressure reduction, a ripple effect of a pressure wave is also applied along the surface and therefore can provide an additional effect to the patient. This can provide a new therapeutic effect for the mattress, where the blood flow of the patient is augmented as part of the pressure relief therapy, which in effect mimics a manual massage.

Any improvement in the patient blood's flow to the tissue therefore further improves the performance of the product in terms of both the prevention and the treatment of pressure ulcers.

In addition, any increase in blood flow is also of benefit to sedentary patients who may be susceptible to other circulation-related problems, such as venous stasis.

Example

Figure 5:
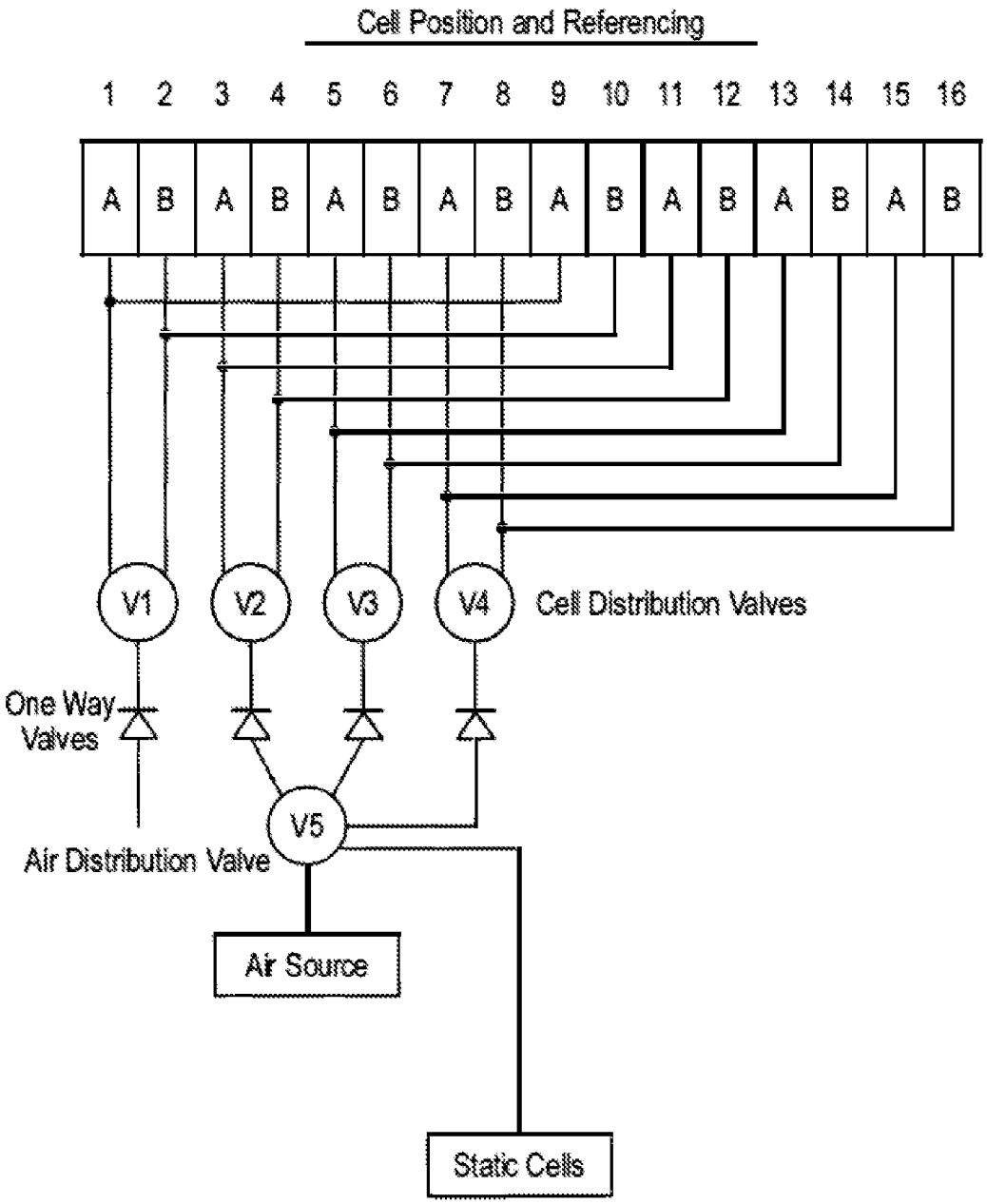
FIG. 5 shows an example embodiment of the phased crossover approach using the use of a distributed valve control.

An example embodiment of the present invention is shown in FIG. 5.

Whilst rotary valves are shown as a means of controlling the air path it is within the scope of the invention that other arrangements could be used, such as solenoid valves.

Cells 1 & 2 in FIG. 5 are examples of pairs of cells where the A & B cells are located in proximity to each other. Cells 9 & 10 are also connected to Cells 1 & 2 but these two pairs of cells are physically separated on the mattress.

Cells 1 & 9 are A cells connected together and have the same pneumatic signal and are fed from valve V1.

Cells 2 & 10 are B cells connected together and have the same pneumatic signal and are fed from valve V1.

Valve V1 provides the A-B alternating control between cells 1 & 9 and also 2 & 10 respectively.

This arrangement is repeated for the remaining pairs of cells forming the surface.

Valve V5 provides the overall air distribution to provide the necessary air feed to each of subsequent valves V1-V4. If the timing of the phase difference is set up conveniently, the air source is provided to only 1 or perhaps 2 of the 4 separate cell distribution valves at any particular time (this is shown in FIG. 5 and Table 1). In normal therapy mode Valve V5 will cycle from positions 1 to 4 in a repeating manner to provide the differential pressure required for the phased inflation. Valves V1 to V4 provide the individual A & B cell distribution, crossover and vent timing.

In addition to the above feed of air to the cell distribution valves, additional static cells can also be connected to the main air distribution valve to provide for the maintenance of pressure in these cells. These are non-alternating and typically used for the head section or as an underlay area to provide additional support.

This valve approach provides for a faster inflation of the static cells—for example during initial installation and after a deflation (e.g. CPR). This valve position allows only the static cells to be inflated without the alternating cells. Since the patient can be supported on just the static cells then this valve connection provides a means of providing an initial inflation of the mattress.

Valve V5 can also contain a position where the input and output of the air source can be reversed. This can result in a change of air direction thereby allowing the active evacuation of the air in the mattress. This is useful in improving the speed and effectiveness of the de-commissioning process at the end of use of a mattress and aids the packing of the mattress after use.

Valve V5 can also contain additional positions where the air source can be directed to other outlets for various additional features within the mattress. These could include ventilation, microclimate and patient turn-assist features.

The timing of the various valves are controlled via a microcontroller and software to allow the relationship to be adjusted and differing operating modes/functions to be selected.

Each valve has its own positional feedback so the microcontroller is aware of the position of each valve and can arrange them in the necessary position in order to provide the phased crossover effect.

TABLE 1

| Example of valve arrangement to provide connections from a single air source to multiple independent valves. | | | | | | |
|---|---|---|---|---|---|---|
| State of Air Distribution Valve V5 | Cell Distribution Valve 1 | Cell Distribution Valve 2 | Cell Distribution Valve 3 | Cell Distribution Valve 4 | Static | Notes |
| 1 | Connected & providing air | Isolated | Isolated | Isolated | Not directly connected | Provide air to Valve 1 |
| 2 | Isolated | Connected & providing air | Isolated | Isolated | Not directly connected | Provide air to Valve 2 |
| 3 | Isolated | Isolated | Connected & providing air | Isolated | Not directly connected | Provide air to Valve 3 |
| 4 | Isolated | Isolated | Isolated | Connected & providing air | Not directly connected | Provide air to Valve 4 |
| Static | Isolated | Isolated | Isolated | Isolated | Connected & providing air | Static feed only |
| Additional/Optional V5 valve states | | | | | | |
| Autofirm | Connected & providing air | Connected & providing air | Connected & providing air | Connected & providing air | Connected & providing air | Allows for connection to all valves (V1-V4) and cells |
| Vent static cells only | Isolated | Isolated | Isolated | Isolated | Connected & venting to atmosphere | Allows direct deflation of static only. |
| Vent all Alternating cells only | Connected & Venting to atmosphere | Connected & Venting to atmosphere | Connected & Venting to atmosphere | Connected & Venting to atmosphere | Isolated | Allows venting of alternating cells only. |
| Vent V1 connected cell | Connected & evacuating air | Isolated | Isolated | Isolated | Isolated | Air drawn from V1 (A or B or both) |
| Vent V2 connected cell | Isolated | Connected & evacuating air | Isolated | Isolated | Isolated | Air drawn from V2 (A or B or both) |
| Vent V3 connected cell | Isolated | Isolated | Connected & evacuating air | Isolated | Isolated | Air drawn from V3 (A or B or both) |
| Vent V4 connected cell | Isolated | Isolated | Isolated | Connected & evacuating air | Isolated | Air drawn from V4 (A or B or both) |
| Vent All cells | Connected & Venting to atmosphere | Connected & Venting to atmosphere | Connected & Venting to atmosphere | Connected & Venting to atmosphere | Connected & Venting to atmosphere | Vent entire mattress |
| Evacuate Mattress alternating only | Connected & evacuating air | Connected & evacuating air | Connected & evacuating air | Connected & evacuating air | Isolated | Evacuate air |
| Evacuate Mattress-static only | Isolated | Isolated | Isolated | Isolated | Connected & evacuating air | Evacuate air |
| Evacuate All Mattress | Connected & evacuating air | Connected & evacuating air | Connected & evacuating air | Connected & evacuating air | Connected & evacuating air | Evacuate air |

TABLE 1-continued

| Example of valve arrangement to provide connections from a single air source to multiple independent valves. | | | | | | |
|---|---|---|---|---|---|---|
| Transport | Cross coupled | Cross coupled | Cross coupled | Cross coupled | Cross coupled | Evacuate air |

Definitions

"Connected & providing air" = V5 is connected ONLY to the individual distribution valve identified and can source air.

"Connected & venting" = V5 is connected ONLY to the individual distribution valve identified and is venting air to atmosphere.

"Isolated" = not connected to the air source via V5 or to any other valve/cell connection.

"Not directly connected" = No connection via Valve V5. However static can still be fed as from outputs of V1-V4 without direct connection to V5.

"Cross Coupled" = All valves V1-V4 are connected together. The air source is isolated to avoid leakage from the cells.

"Connected & evacuating air" = V5 is connected ONLY o the individual distribution valve identified and can source air.

By having a separate pneumatic circuit for each pair of cells then the system can be arranged to be more resilient to the effect of individual cell-based leaks. A leak in one cell will not affect the pressures in cells not connection to the same distribution valves. This provides for increased fault tolerance in the design of the system. Hence the opportunity for systemic leaks is significantly reduced and the risks associated with the failure to support the patient under fault conditions are reduced.

The same pneumatic source can be used for multiple pairs of cells, this reduces the complication associated with the approach. In the example embodiment shown in FIG. 5 the air source is provided to the cell distribution valves under the control of a further air distribution valve.

In standard alternating surfaces, it is usual to have the A & B cells arranged in a repeating and consistent manner. It is possible that that the mattress could be arranged differently to taken advantage of the phased crossover arrangement by interspacing of A and B cells from a given distribution valve with cells from other valves. An example of this arrangement would be A1, B2, A3, B1 where the A & B cells of valve 1 (A1, B1) are separated by the B cell from valve 2 and the A cell from valve 3. The A & B sequence is continued, the phasing of the valves is the same but the end effect on the surface is different. This approach would be aimed at separating the movement as widely as possible across the mattress.

It is also envisaged that there could be provided physical separation of those cells that have the same pressure profile within the mattress as a whole. FIG. 5 shows valve V1 controlling both cells 1 & 2 and also cells 9 & 10 which are remote to 1 & 2. This separates in distance the commonly connected cells whose pressures change at the same time and hence also separates the location where any movement occurs and as a result there is less overall sensed movement. In order for the sensation of large scale movement to be reduced, movement should be distributed as far as possible, hence in the preferred embodiments avoid having adjacent pairs of cell which are connected to the same distribution valve.

With reference to the embodiment of FIG. 5, it should be appreciated that cell distribution valves can be separate or combined into a single valve. They are shown separately for clarity. One way valves are optional. Cell distribution valves provide required A-B-vent control for each connected pair of cells. Furthermore, a static connection is optional.

In order to produce a peristaltic-like pressure wave effect then the pairs of cells which are most similar in phase should be physically located as close as possible to each other in the mattress. Also there should be a continual phase gradient which is directly associated with two or more pairs of cells.

Maintenance of patient support—it is important that there is sufficient continued support provided to the patient. Therefore the interspaced A-B-A cell relationship is maintained to ensure that there are no areas of the mattress where the patient is not supported. For example, a cell arrangement of the form A-A-A-B would result in a larger physical area receiving minimal support in the region of the A cells for defined periods during the cycle.

The advantages of the method and apparatus taught herein include:

1) the same clinical benefits of a '1 of 2' system are available as the same pressure is still relieved at the same rate between adjacent cells in a pair. So each pair of cells continues to provide the same therapeutic performance as before;

2) the movement of the entire surface at any point in the cycle is reduced as there are less individual cells changing pressure and therefore the patient is subjected to less movement on the surface;

3) since less air is moving at any given time, the audible noise produced in the pump supplying the air and the associated airflow in the mattress is reduced;

4) the pneumatic loading required to be provided by the compressor is reduced as less air flow is needed at any particular time in order to hit the target pressure. Hence a lower compressor output is required to achieve the same therapy as would be the case without the phased crossover. This can therefore result in a reduction in compressor noise, compressor cost, heating, energy use as well as offer an increase in compressor service life;

5) the phased change in the pressures provides a pressure wave effect along the mattress (similar to that of a peristaltic pump). This occurs within the cells within the surface but results in a new effect in terms of the pressure applied to the patient. This is most evident in terms of the surface supporting the patient legs where it is possible to provide a moving pressure gradient or wave which can have an additional therapeutic effect on the patient;

6) the pressure wave can also provide an improvement in the perception of the comfort as there is a relaxation element associated with the progressive pressure wave resulting in a massaging effect of the areas of the patient's body in contact with the cells;

7) this massaging can have a range of further beneficial effects to the associated with the improvement of oxygenation and fluid movement in the patient's soft tissue;

8) the described resultant pressure wave can be oriented in terms of a defined direction within the mattress so it can also act to help prevent the patient from progressively moving to the bottom of the bed as a result of gravity and normal patient motion an alternating support surface. This patient movement situation can particularly occur when the bed is in a gatched position with the backrest raised or in other common bed positions such as reverse-Trendelenburg. For example, if the pressure wave has a generally upward sequence (i.e. mattress foot to head) then there is a resultant wave of force applied to the patient to counter that of the patient.

Embodiments of the invention can also have one or more of the following characteristics:

1) a phase relationship describable in terms of the relative pressure and timing of pressure profiles between adjacent sets of pairs of cells;

2) the use of a phase relationship between sets of pairs of cells where the phase relationship is less than 50% of the overall cycle time;

3) the use of a phase relationship between sets of pairs of cells where the phase relationship is less than 25% of the overall cycle time;

4) the use of a phase relationship between sets of pairs of cells where the phase relationship is less than the inflation time of that of an individual cell. (This can provide for interlocking of the inflations as shown in FIG. 3);

5) a phase relationship describable in terms of the relative pressure and timing of pressure profiles between non-adjacent pairs of cells; and 6) physical separation of cells with the same phase relationship—e.g. by one or two cell positions.

In at least some embodiments of the invention the mattress could be designed or arranged to apply in the area of the torso or sacrum a therapy procedure which different to that elsewhere in the mattress. A modified therapy could in particular provide improved support, particularly useful when a patient is moved from a reclining position to a sitting up position. The mattress may produce different pressure levels in different zones, for example at the sacrum or lower torso zone, with or without phase timing of the inflation/deflation characteristics of cells in this mattress zone. In some embodiments inflation of the zone or zones is effected in time offset phases with other zones of the mattress, in particular to inflate the zone over a different phase to that used elsewhere in the mattress, in order to generate a different inflation effect.

Figure 6A:
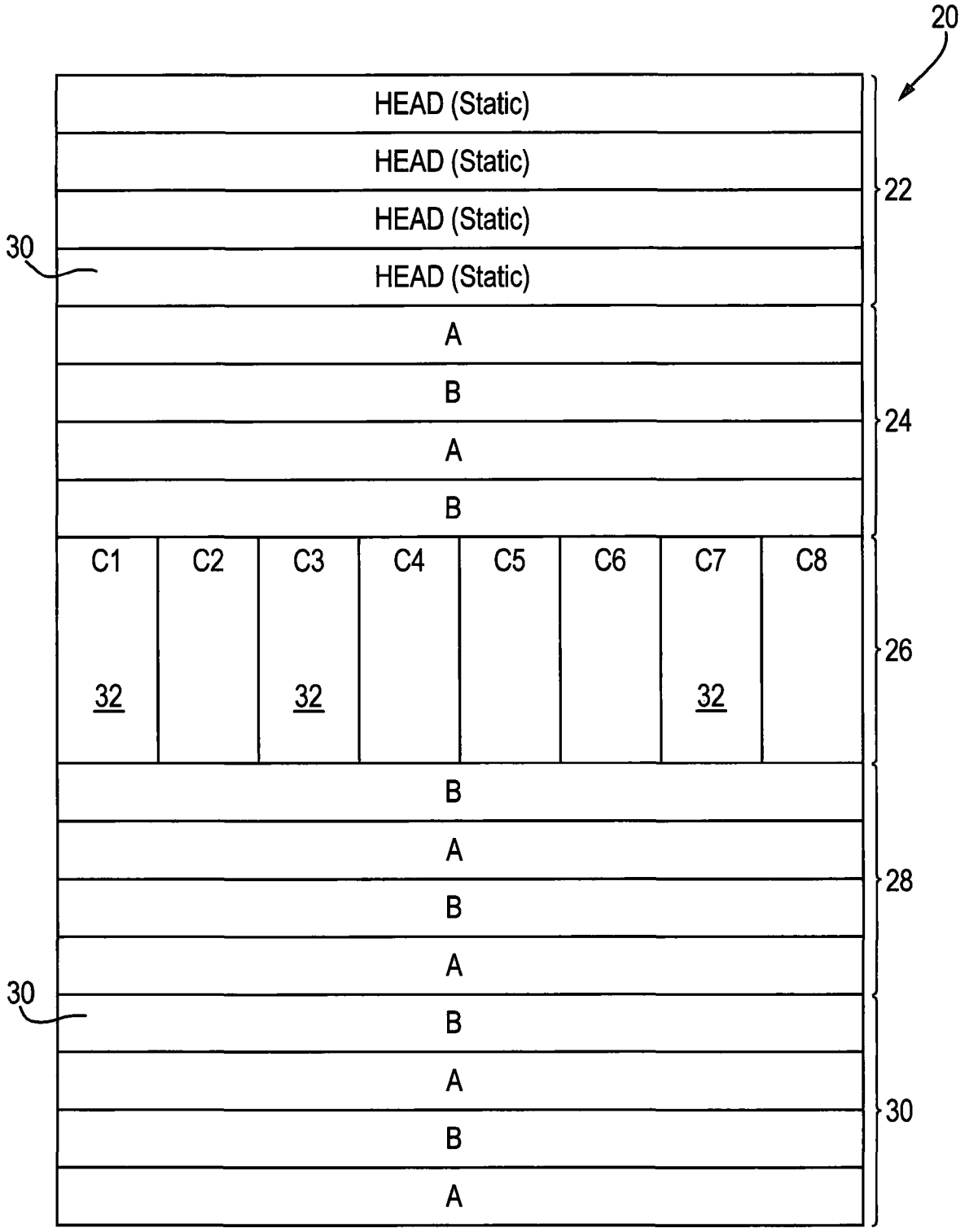
FIGS. 6A and 6B are, respectively, schematic diagrams in plan view and side elevational view of an embodiment of mattress.
Figure 6B:
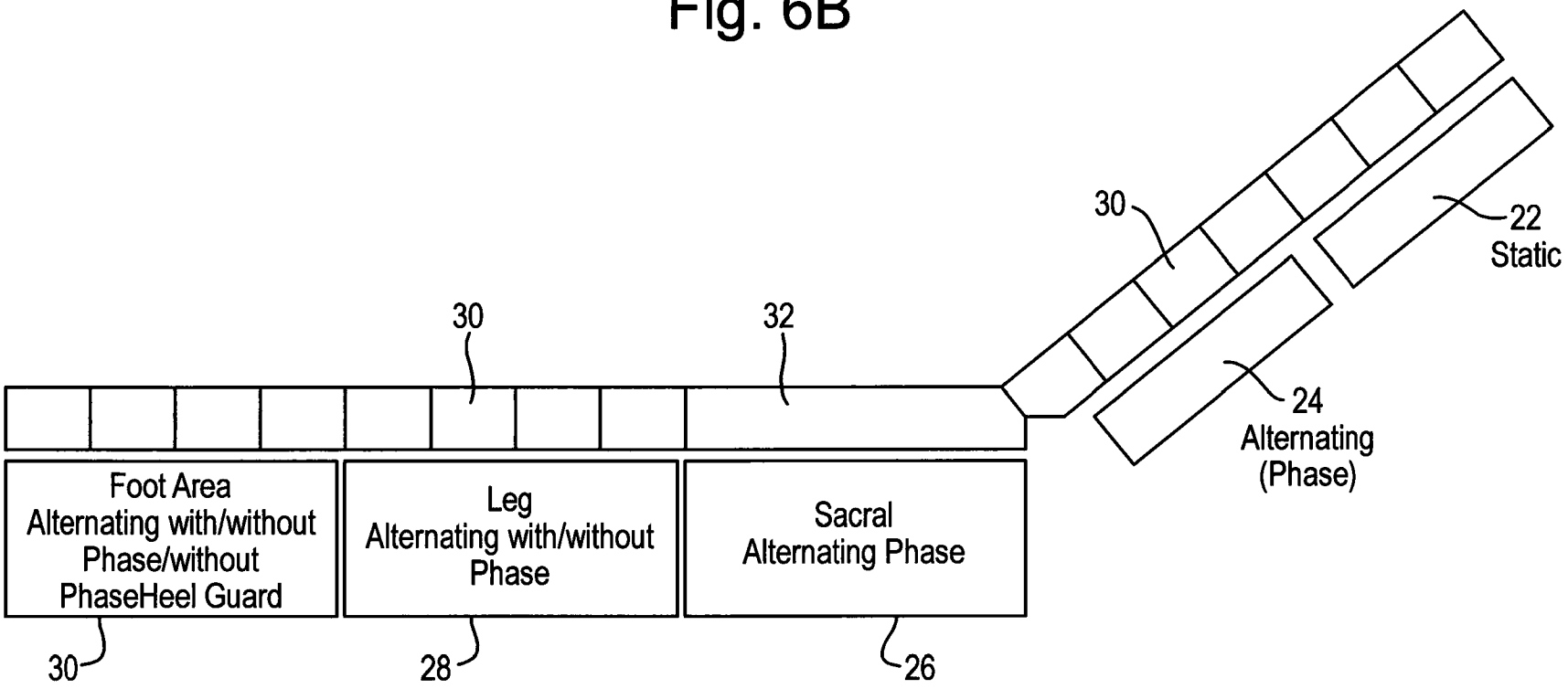

Referring now to FIGS. 6A and 6B, these show an embodiment of inflatable mattress having different inflatable elements in different zones of the mattress. More specifically, the mattress includes a plurality of zones, in the example shown a head zone 22, a torso zone 24, a sacral zone 26, a leg zone 28 and a foot zone 30. In this embodiment all the zones save for the sacral zone 26 are each formed of a plurality of elongate transversally disposed inflatable cells 30 coupled to a manifold of the type shown in FIG. 5 in order to provide phased cell inflation. The sacral zone 26, on the other hand, is formed from a plurality of elongate inflatable cells 32 which extend in a longitudinal direction and thus substantially perpendicular to the cells 30. Thus, the cells 32 in the sacral area are at 90 degrees to the cells in the other parts of the mattress 20, so in the sacral zone 26 the longest cell length is along the mattress and the cell shortest size is across the width of the mattress In the embodiment shown, the cells of the head zone 22 are inflated to a given pressure and then kept at that pressure with no pressure cycling, in other words at a static pressure. The cells 30 of the zones 24, 28 and 30 are, in this embodiment, cycled between cells A and B and may or may not be phase offset, either from one zone to the next or within each zone. The cells 32 of the sacral zone 26 may be kept at a static pressure but in this embodiment are preferably cycled and preferably in phased offset with respect to the other zones of the mattress 20.

Thus, the phase relationship could also be applied to certain cells are arranged longitudinally, that is, at 90 degrees to the other lateral cells in the mattress. This difference can apply in specific mattress zones, for example around the centre of the bed length and around the patient's sacral area. This structure can allow for a mattress having a greater variety of cell features around the patient's torso, for instance to allow for patient care such as toileting, bathing, nursing procedures and so on.

The embodiments of mattress disclosed herein can thus allow for different areas or zones of the mattress to have different phase relationships. For example, the phase relationship of the pressures in the cells in the patients sacral region could be different from that applied in other areas of the mattress. This configuration is advantageous as it allows a specific localized therapy to be provided in this physical area of the patient compared to that provided elsewhere on the mattress.

Similarly, the embodiments disclosed herein may also have a cell arrangement which includes a plurality of inflatable cells arranged longitudinally compared to others. These cells are typically orientated longitudinally in the area of the mattress that corresponds to the sacral area of the patient. They allow the system to provide improved therapeutic operation within that region of the mattress. This mode of operation can be selected by the pump to provide additional functions and features when required.

All optional and preferred features and modifications of the described embodiments and dependent claims are usable in all aspects of the invention taught herein. Furthermore, the individual features of the dependent claims, as well as all optional and preferred features and modifications of the described embodiments are combinable and interchangeable with one another.

The disclosure in the abstract accompanying this application is incorporated herein by reference.

The invention claimed is:

1. Inflatable mattress apparatus including a mattress provided with a plurality of inflatable cells; a manifold unit connected to the plurality of cells, wherein the manifold couples the cells into a plurality of individual sets of cells; and a control unit connected to the manifold, the control unit configured to inflate a first cell in each set of cells substantially simultaneously with deflating a second cell in each set of cells over a period, and to provide time offset inflation and deflation of cells in different sets of cells, wherein the time offset between sets of cells provides overlapping inflation periods between the first cell in each of at least two of said sets of cells and overlapping deflation periods between the second cell in each of the at least two of said sets of cells, wherein a first valve controls inflation and deflation of a first set of adjacent cells and a second set of adjacent cells, wherein a second valve controls inflation and deflation of a third set of adjacent cells located between the first set of adjacent cells and the second set of adjacent cells, and wherein the control unit is configured to provide time offset inflation and deflation of cells between the at least two sets of cells, such that cells in the first set of adjacent cells are not inflated and deflated over identical time periods as cells in a second set of adjacent cells.

2. Apparatus according to claim 1, wherein a phase relationship between sets of cells is less than 50% of said period.

3. Apparatus according to claim 1, wherein each set of cells is independently coupled to the manifold and independently controllable.

4. Apparatus according to claim 1, wherein two or more sets of cells are jointly coupled to the manifold and/or jointly controllable.

5. Apparatus according to claim 1, wherein the manifold includes a valve unit coupled to each cell of a set of cells.

6. Apparatus according to claim 1, wherein the control unit is operable to inflate and deflate the cells of the sets of cells in an order to produce a travelling pressure wave along at least a part of a surface of the mattress.

7. Apparatus according to claim 1, wherein each set of cells comprises two cells.

8. Apparatus according to claim 7, wherein at least one cell of each set of cells is inflated simultaneously with deflation of at least one other cell in the set of cells.

9. Apparatus according to claim 1, wherein cells located solely in a sacral zone of the mattress are arranged perpendicular to cells located in other zones of the mattress, and wherein the perpendicularly arranged cells located in a sacral zone are operated at a different inflation profile to cells in other zones of the mattress.

10. The inflatable medical mattress according to claim 1, comprising: a longitudinal extent with a head zone at one end, a foot zone at the opposite end and a sacral zone between the head and foot zones, and a transverse extent; wherein the plurality of inflatable cells is arranged in the head zone, the foot zone, and the sacral zone, wherein in at least one of the zones the inflatable cells are elongate and oriented substantially parallel to the transverse extent of the mattress and in at least the sacral zone the cells extend substantially parallel to the longitudinal extent of the mattress.

11. An inflatable mattress according to claim 10, wherein transversally extending cells extend from one side to the other of the mattress.

12. An inflatable mattress according to claim 10, wherein the cells in all the mattress zones apart from the sacral zone are elongate and extend in the transverse direction of the mattress.

13. An inflatable mattress according to claim 10, wherein different areas of the mattress are arranged to have different phase relationships.

14. A method of inflating a mattress provided with a plurality of inflatable cells through a manifold unit connected to the plurality of cells, wherein the manifold couples the cells in a plurality of individual sets of cells; including the steps of:

substantially simultaneously inflating a first cell in each set of cells and deflating a second cell in each set of cells over a period such that the cells in a first set of adjacent cells are not inflated and deflated over identical time periods as cells in a second set of adjacent cells, wherein the time offset between sets of cells provides overlapping inflation periods between the first cell in each of at least two of said sets of cells and overlapping deflation periods between the second cell in each of the at least two of said sets of cells, and wherein the mattress comprises a first valve for inflation and deflation of the first set of adjacent cells and the second set of adjacent cells, and a second valve for inflation and deflation of a third set of adjacent cells located between the first set of cells and the second set of adjacent cells.

15. A method according to claim 14, wherein a phase relationship between sets of cells is less than 50% of said first and second periods.

16. A method according to claim 14, including the step of inflating and deflating the cells in an order to produce a travelling pressure wave along at least a part of a surface of the mattress.

* * * * *